US007857950B1

(12) United States Patent
North

(10) Patent No.: US 7,857,950 B1
(45) Date of Patent: Dec. 28, 2010

(54) SACRIFICIAL ANODE MOUNTING SYSTEM

(76) Inventor: James North, 1421 Palm Ave., SW., Seattle, WA (US) 98116

( * ) Notice: Subject to any disclaimer, the term of this patent is extended or adjusted under 35 U.S.C. 154(b) by 298 days.

(21) Appl. No.: 12/287,255

(22) Filed: Oct. 7, 2008

Related U.S. Application Data

(60) Provisional application No. 60/998,045, filed on Oct. 9, 2007.

(51) Int. Cl.
*C23F 13/18* (2006.01)

(52) U.S. Cl. ..... 204/196.17; 204/196.3; 204/196.31; 204/279; 204/286.1; 204/288.4; 204/297.01

(58) Field of Classification Search ..... 204/196.17, 204/196.3, 196.31, 279, 286.1, 288.4, 297.01
See application file for complete search history.

(56) References Cited

U.S. PATENT DOCUMENTS 3,803,012 A 4/1974 Kurr
3,803,016 A * 4/1974 Conner, Jr. ..... 204/288.1
3,882,419 A * 5/1975 Swartz et al. ..... 331/96
4,176,033 A 11/1979 Council
4,191,625 A * 3/1980 Sabins ..... 204/196.17
4,409,081 A 10/1983 Terrase
4,468,310 A * 8/1984 Sabins ..... 204/196.07
5,902,463 A 5/1999 Terrase
5,932,087 A 8/1999 Terrase

* cited by examiner

*Primary Examiner*—Bruce F Bell
(74) *Attorney, Agent, or Firm*—Harpman & Harpman

(57) ABSTRACT

A mounting plate assembly for selectively securing a sacrificial anode to the exposed surface of a tank or boat hull. The mounting plate assembly provides for a pair of watertight space mounting studs to be extended through the attached surface and provide anode engagement thereon. The studs are welded to both the mounting plate and a fixation nut on the plate to which the anode is correspondingly registerably engaged.

6 Claims, 2 Drawing Sheets

SACRIFICIAL ANODE MOUNTING SYSTEM

This application claims the benefit of U.S. Provisional Application No. 60/998,045, filed Oct. 9, 2007.

BACKGROUND OF THE INVENTION

1. Technical Field

This invention relates to mounting of sacrificial anode to prevent corrosion which will occur when a galvanic reaction is induced in specific environments.

2. Description of Prior Art

Prior art mounting of sacrificial anodes in liquid environments such as boats typically use a pair of bolts inserted through the hull from the inside secured with nuts and washers. The anode is then typically attached using the same bolts which could loosen over time based on subjective anode replacement which is required periodically due to its sacrificial nature.

Other prior art mounting and anode protection devices can be seen in U.S. Pat. Nos. 3,803,012, 4,176,033, 4,409,081, 5,902,463 and 5,932,087.

In U.S. Pat. No. 3,803,012, a cathodic protection anode clamp assembly can be seen having a clamp member with an integrated sacrificial anode on its adjustable bolt for clamping onto a pipeline to be protected.

An anode clamp assembly is illustrated and method of installation is disclosed in U.S. Pat. No. 4,176,035 having U-shaped clamps from which extend a pair of anodes in spaced relation thereto.

U.S. Pat. No. 4,409,081 discloses a sacrificial anode assembly for use on marine structures in which an anode bar has an anode core extending therethrough with assembly disposed angled and protrusion that attach to the marine platform.

U.S. Pat. No. 5,902,463 claims a submersible anode and method having a pair of adjustable clamp assemblies adapted to fit onto different dimensions and wall pipe configurations with an anode supported therebetween.

Finally, U.S. Pat. No. 5,932,087 discloses another submersible anode configuration by the same inventor having modified adjustable mounting brackets with a spaced cast anode on the bracket element between the respective hook hanger bracket configurations.

SUMMARY OF THE INVENTION

A so-called dry zinc mounting system to provide for a liquid tight seal to fixation fasteners used to removably secure a sacrificial anode to a mounting surface. A sealing plate having multiple fastener elements is secured thereto and through the mounting surface to provide corresponding extending mounting elements for a sacrificial anode to be attached in a liquid environment.

DETAILED DESCRIPTION OF THE INVENTION

Figure 1:
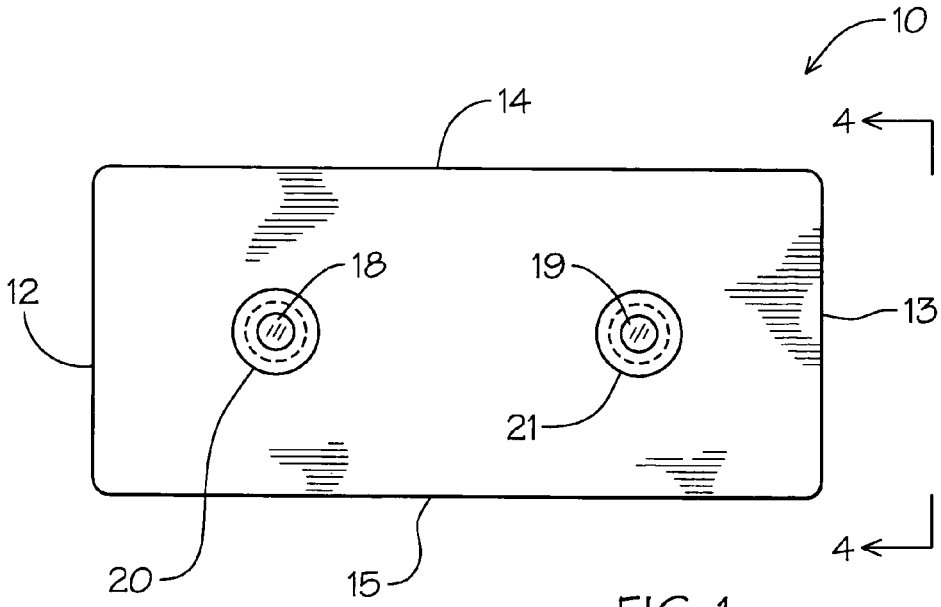
FIG. 1 is a bottom plan view of the mounting system of the invention.
Figure 2:
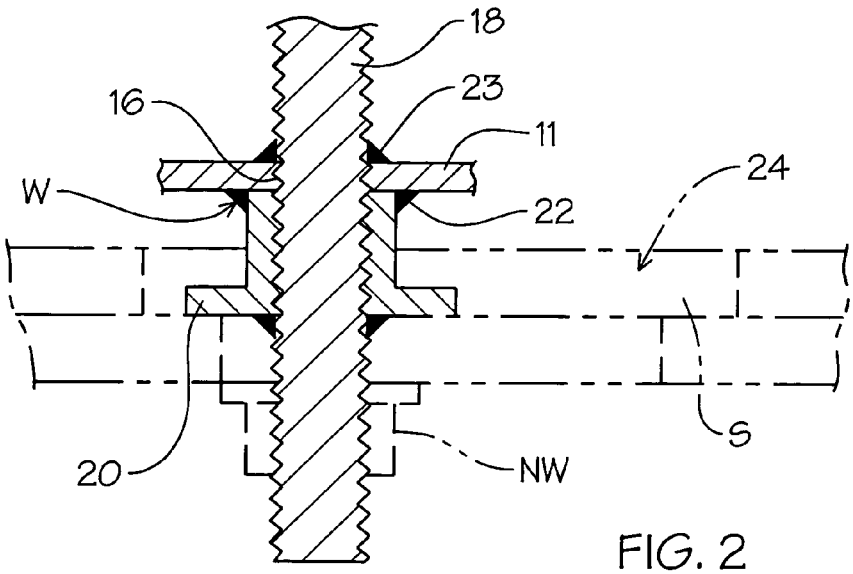
FIG. 2 is an enlarged partial sectional view of the stud mount.

Referring to FIGS. 1 through 4 of the drawings, an anode mounting system 10 of the invention can be seen having a sealing base plate 11 of a generally rectangular configuration with oppositely disposed end edges 12 and 13 and side edges 14 and 15. The base plate 11 has pair of apertures A inwardly of its respective end and side edges 12-15 in spaced longitudinal alignment to one another indicated at 16 and 17.

Figure 3:
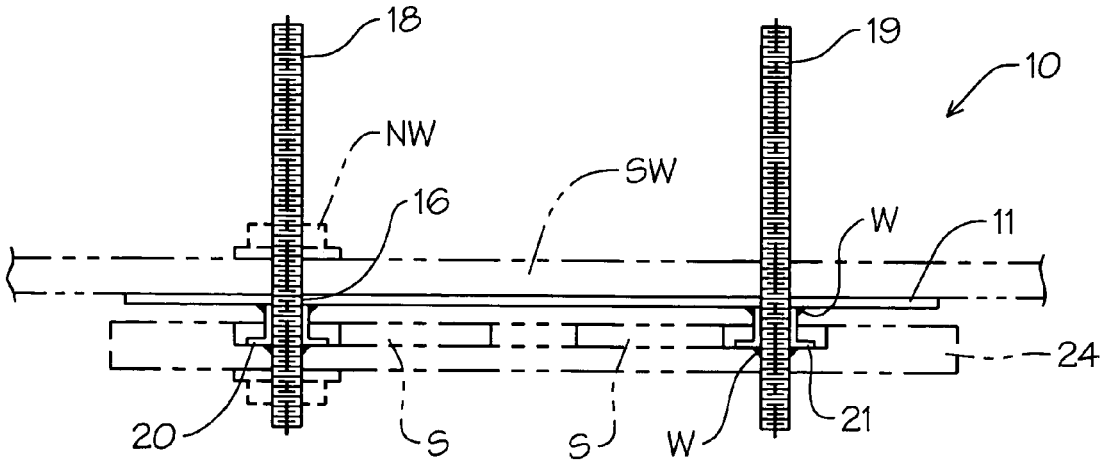
FIG. 3 is a side elevational view thereof with an anode shown with broken lines positioned thereon.
Figure 4:
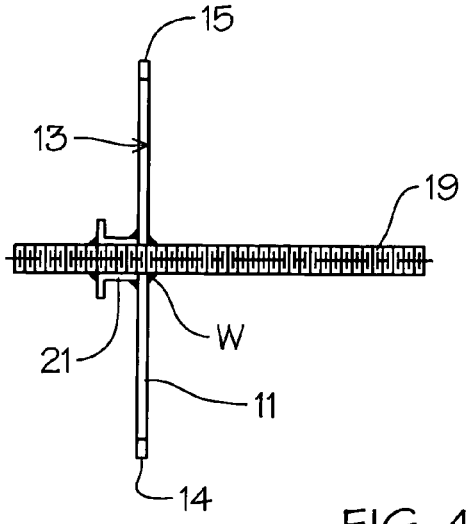
FIG. 4 is an end elevational view of the mounting plate system shown in FIG. 1.

A pair of threaded studs 18 and 19 are positioned through the respective apertures and secured in place by welding at W, best seen in FIG. 3 of the drawings.

A corresponding pair of flanged base nuts 20 and 21 is threadably engaged on the studs 18 and 19 respectively up against the base plate 11 and welded in place around both the studs 18 and 19 and the surface of the base plate 11 as indicated at 22 and 23.

The multiple continuous welds assure a liquid tight seal of the studs 18 and 19 through the base plate 11 which is correspondingly sealingly engaged against a support surface as will be discussed hereinafter.

In use, the studs 18 and 19 extend through corresponding aligned openings in a mounting support wall SW shown in broken lines in FIG. 3 of the drawings imparting a large sealing surface of the base plate 11 against the wall SW and held there by conventional washers and threaded nut NW assemblies shown in broken lines registerably engaged on the opposite non-liquid side surface of the support wall SW as it will be well-known and understood within the art. This arrangement assures a fixed liquid-tight mounting seal against the wall SW with extending non-rotatable mounting studs 18 and 19 for the sacrificial anode 24 to removably secured thereon as shown in broken lines in FIGS. 2 and 3 of the drawings.

It will be evident from the above description by use of the combination of flanged base nuts 20 and 21 continuously welded to the respective studs 18 and 19 and base plate 11 that the replaceable anode 24 can be securely mounted thereto in space relation to the base plate 11 by use of conventional washers and locking nuts, as noted.

Additionally, by use of the flanged base nuts 20 and 21, the application of excessive torque during mounting of the anode against the conventional retaining washer and locking nut assembly will prevent inadvertent stud rotation and pull-through as heretofore may occur.

Typically, the sacrificial anode 24 is composed of zinc which is well-suited as a sacrificial material in such applications and in this example the anode 24 is of a commercially available rectangular configuration, with a pair of recessed mounting slots S on the longitudinally aligned space relation therein.

As noted, the anode 24 will be registerably engaged against the flanged base nuts 20 and 21 providing a secure mounting surface for the application of retainment pressure by the corresponding washer and locking nut assembly rotatably positioned on the end of the stud holding the anode in place as previously described.

It will thus be seen that a new and novel sacrificial anode mounting and retainment assembly has been illustrated and described for a variety of environments. It will be apparent to those skilled in the art that various changes and modifications may be made thereto without departing from the spirit of the invention.

Therefore I claim:

1. A sacrificial anode mounting assembly for use in a liquid environment comprising, an apertured base sealing plate, a pair of threaded studs extending through said apertures in said plate, stud retainment nuts threadably engaged on said respective studs in communication with said plate, said stud retainment nuts weldably secured to said base plate and said studs, said studs threadably secured to said base plate, an anode registerably secured to said stud retainment nuts in spaced relation to said base plate, means for securing said base plate on a surface support surface wall.

2. The sacrificial anode mounting assembly set forth in claim 1 wherein said stud retainment nuts have a flanged anode engagement surface welded to said studs.

3. The sacrificial anode mounting assembly of claim 1 wherein said welded stud retainment nuts to said base plate and said studs are continuously welded thereto.

4. The sacrificial anode mounting assembly set forth in claim 1 wherein said anode is registerably secured to said stud retainment nut in spaced parallel relation to said base plate by a threaded nut and washer assembly.

5. The sacrificial anode mounting assembly set forth in claim 1 wherein said means for securing said base plate on said surface support wall comprises, a threaded nut and washer assembly on said respective studs in oppositely disposed relation to said stud retainment nuts and registerable on said support wall.

6. The sacrificial anode mounting assembly set forth in claim 1 wherein said anode has recessed mounting apertures therein for receiving said studs extending from said stud retainment nuts.

* * * * *